United States Patent [19]

Hino et al.

[11] Patent Number: 4,983,457

[45] Date of Patent: Jan. 8, 1991

[54] HIGH STRENGTH, ULTRA HIGH MODULUS CARBON FIBER

[75] Inventors: Takashi Hino; Hiroyuki Kurodo; Kaoru Hirokawa, all of Saitama, Japan

[73] Assignee: Toa Nenryo Kogyo Kabushiki Kaisha, Tokyo, Japan

[21] Appl. No.: 484,006

[22] Filed: Feb. 22, 1990

Related U.S. Application Data

[63] Continuation of Ser. No. 198,959, May 26, 1988, abandoned.

[30] Foreign Application Priority Data

May 31, 1987 [JP] Japan ..... 62-135822

[51] Int. Cl.[5] ..... D02G 3/00

[52] U.S. Cl. ..... 428/367; 208/39; 264/29.2; 423/447.2; 423/447.4

[58] Field of Search ..... 428/364, 367, 408; 423/447.2, 447.4; 264/29.2; 208/39, 44

[56] References Cited

U.S. PATENT DOCUMENTS

| | | | |
|---|---|---|---|
| 3,919,376 | 11/1975 | Schulz | 423/447.4 X |
| 3,919,387 | 11/1975 | Singer | 423/447.4 X |
| 3,974,264 | 8/1976 | McHenry | 423/447.4 |
| 3,995,014 | 11/1976 | Lewis | 423/447.4 |
| 4,005,183 | 1/1977 | Singer | 423/447.4 X |
| 4,017,327 | 4/1977 | Lewis | 423/447.4 X |
| 4,209,500 | 6/1980 | Chwastiak | 423/449 X |

*Primary Examiner*—Lorraine T. Kendell

*Attorney, Agent, or Firm*—Seidel, Gonda, Lavorgna & Monaco

[57] ABSTRACT

A high strength, ultra high modulus carbon fiber is characterized by the presence of the (112) cross-lattice line and the resolution of the diffraction band into two distinct lines (100) and (101), which indicate the three-dimensional order of the crystallite of the fiber. It has an interlayer spacing ($d_{002}$) of 3.371 to 3.40 Å; a stack height ($Lc_{002}$) of 150 to 500 Å; and a layer size ($La_{110}$) of 150 to 800 Å.

3 Claims, 2 Drawing Sheets

HIGH STRENGTH, ULTRA HIGH MODULUS CARBON FIBER this is a continuation of copending application Ser. No. 198,959 filed on May 26, 1988 now abandoned.

Background of the Invention

1. Field of the Invention

The present invention relates, in general, to a carbon fiber, and, in particular, to a high strength, ultra high modulus carbon fiber which may be used, as a structural material of light weight, for various industries such as space, motor car, aircraft, architecture and other widespread technical fields.

2. Description of the Related Art

Up to now, as a carbon fiber a PAN based carbon fiber has been widely manufactured and utilized. Some PAN based carbon fiber exhibits a strength as high as 5.6 GPa, but its elasticity, e.g., 290 GPa is not high. Even a newly developed high modulus PAN based carbon fiber possesses an elastic modulus of only 490 GPa (and 2.4 GPa strength), and no PAN based carbon fiber with an elastic modulus of 500 GPa or more has been found. This is a material reason why a PAN based carbon fiber is restricted in improving its crystallization (i.e. the degree of graphitization) due to its non-graphitizable property, so that it is substantially difficult to produce an ultra high modulus PAN based carbon fiber.

On the other hand, some pitch based carbon fiber, e.g., a graphitized carbon fiber heated at up to 2,800° C., is provided with properties in 1.7 to 2.4 GPa strength and 520 to 830 GPa elastic modulus (see U.S. Pat. No. 4,005,183). Actually, an ultra high modulus pitch based carbon fiber with 830 GPa elastic modulus and 2.2 GPa strength has been developed and introduced into market (see Pure & Appld. Chem. Vol. 57, No. 11, 1553 (1985)).

Such an ultra high modulus pitch based carbon fiber, however, has a low strength, as seen from the above, and an ultra high modulus pitch based carbon fiber with a strength as high as 2.5 GPa or more, however, has not yet been developed. A big problem has arisen in particular, in producing composite materials from such a pitch based ultra high modulus graphitized carbon fiber, due to its low strength, i.e., its low elongation resulting in the difficulties of handling the fiber.

The present inventors have sought to obtain a pitch based carbon fiber with high performance such as both ultra high elastic modulus and high strength. As a result of extensive investigation, the present inventors have found that a high strength, ultra high modulus carbon fiber can be obtained by producing a carbon fiber the crystal structure of which is specific. The present invention is based on such newly obtained findings.

Therefore, an object of the present invention is to provide a carbon fiber which can exhibit both high strength and ultra high modulus.

Another object of the present invention is to provide a high strength, ultra high modulus carbon fiber which can easily be handled and particularly facilitates the production of composite materials.

SUMMARY OF THE INVENTION

The aforementioned objects are realized by a high strength, ultra high modulus carbon fiber according to the present invention. In brief, according to the present invention, there is provided a high strength, ultra high modulus carbon fiber characterized by the presence of (112) cross lattice line and the resolution of the diffraction band into two distinct lines (100) and (101), which indicate the three dimensional order of the crystallite of the fiber; an interlayer spacing ($d_{002}$) of 3.371 to 3.40Å; and a stack height ($Lc_{002}$) of 150 to 500Å; and a layer size ($La_{110}$) of 150 to 800Å. The stack height ($Lc_{002}$) is 170 to 350Å and the layer size ($La_{110}$) is 200 to 450Å, more preferably.

The present inventors, as stated above, have extensively investigated how to obtain a pitch based carbon fiber having high performance such as both ultra high elastic modulus and high strength. As a result, the present inventors have developed a carbon fiber which has a specific crystal structure completely different from the conventional structure. That is to say, the present inventors have found that a carbon fiber can exhibit both ultra high modulus and high strength when it has a good crystallinity, and a three dimensional order structure that indicates a high regularity of the crystal, and, in addition, its interlayer spacing ($d_{002}$) is larger than that of a graphite fiber and the crystallite size is a suitable one. Moreover, the present inventors have found that the stack height ($Lc_{002}$) and the layer size ($La_{110}$), are important factors in determining the crystallite size, and that the factors lie within a suitably balanced range in connection with the aforementioned interlayer spacing.

DETAILED DESCRIPTION OF THE PREFERRED EMBODIMENTS

Figure 1:
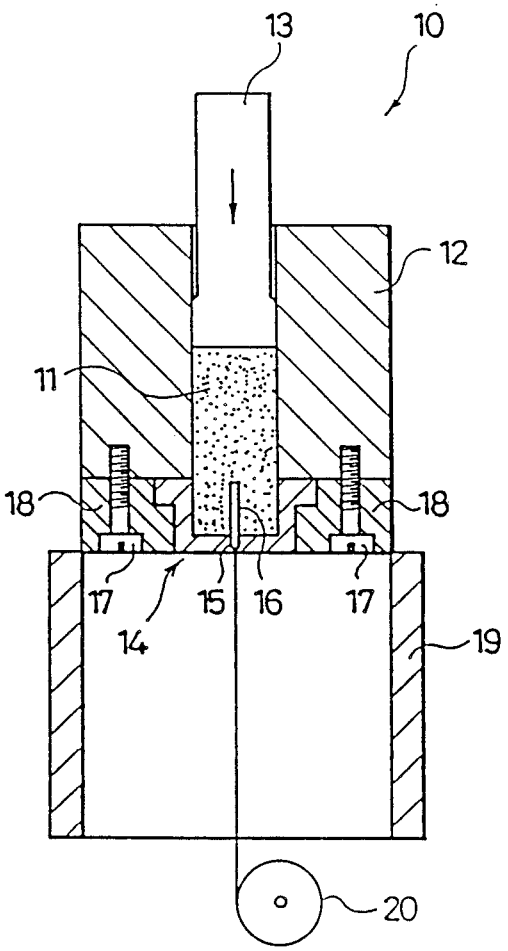
FIG. 1 is a sectional view of an embodiment of a spinning machine, such as to produce a carbon fiber of the present invention.

A high strength, ultra high modulus carbon fiber according to the present invention will now be described in more detail.

It has been widely known that improved crystallinity of a carbon fiber would improve its elastic modulus, and as stated above, some graphite fiber with a remarkably good crystallinity produced from a liquid crystalline pitch exhibits an ultra high modulus of elasticity of 830 GPa. Such a conventional carbon fiber, however, only exhibits a strength as low as 2.2 GPa. This indicates that a high strength, ultra high modulus carbon fiber cannot be realized merely by improving its crystallinity.

The present inventors have studied in detail the relationship between properties and structure of a carbon fiber. As a result, the inventors have found it indispensable, in order to attain an ultra high modulus carbon fiber, that the carbon fiber has a good crystallinity and that, first of all, has a three dimensional order of the crystal indicating high regularity. In other words, it is basically important that the carbon fiber is characterized by both the presence of (112) cross lattice line and the resolution of the diffraction band into two distinct lines (100) and (101). In addition, it is preferable in order to exhibit high strength that the interlayer spacing ($d_{002}$) of the layer planes is larger than that of a graphite fiber and lies within a suitable range, and that the crystallite size is relatively small and fine. Meanwhile, for the carbon fiber to have high strength it has been found indispensable that the stack height ($Lc_{002}$) and the layer size ($La_{110}$), which are important factors in determining the crystallite size, lie within a suitably balanced range in connection with the aforementioned interlayer spacing.

That is to say, the study of the present inventors shows that it is indispensable that:

(1) the interlayer spacing ($d_{002}$) of the layer planes is 3.371 to 3.40 Å which is larger than the interlayer spacing (3.37 Å or less, in general 3.36 to 3.37 Å) of a graphite fiber, (2) the stack height ($Lc_{002}$) is 150 to 500 Å which is smaller than the stock height (1000 Å or more) of the graphite fiber, and (3) the layer size ($La_{110}$) is 150 to 800 Å which is smaller than the layer size (1000 Å or more) of the graphite fiber.

Furthermore, it was found that the carbon fiber obtained exhibits a poor modulus of elasticity, when the interlayer spacing ($d_{002}$) is larger than 3.40 Å, the stack height ($Lc_{002}$) is smaller than 150 Å and the layer size is smaller than 150 Å. In addition, it was found that a sufficient strength of the carbon fiber is difficult to obtain when the interlayer spacing ($d_{002}$) is smaller than 3.371 Å, the stack height ($Lc_{002}$) is larger than 500 Å and the layer size $La_{110}$) is larger than 800 Å.

To sum up, according to the present invention, as stated above, a high strength, ultra high modulus carbon fiber having an elastic modulus of 600 GPa or more and a tensile strength of 2.5 GPa or more can be obtained, by adjusting the crystal structure so that the product obtained is characterized by the presence of (112) cross lattice line and the resolution of the diffraction band into two distinct lines (100) and (101), which indicate the three dimensional order of the crystallite of the fiber; and an interlayer spacing ($d_{002}$) of the layer planes of 3.371 to 3.40 Å; a stack height ($Lc_{002}$) of 150 to 500 Å; and a layer size ($La_{110}$) of 150 to 800 Å. Preferably, the stack height ($Lc_{002}$) is 170 to 350 Å and the layer size ($La_{110}$) is 200 to 450 Å.

The inventors have found that such a high strength, ultra high modulus carbon fiber can be produced suitably, by spinning carbonaceous pitch of which a principal component is an optically anisotropic phase, using spinning nozzles which contain inserted elements made of materials having a good thermal conductivity in order to minimize temperature fluctuation, in particular, temperature decrease of the melt pitch in the spinning nozzles, by infusibilizing the obtained carbonaceous pitch fiber for a time as short as possible (of one hour or less), and then by heating it at a temperature of 2,400° C. or more. Moreover, the infusibilization is performed in the presence of oxygen, oxygen rich air (20 to 100% oxygen content), or an oxidizing gas such as ozone, nitrogen dioxide, etc.

The carbon fiber with a specific crystalline structure of the present invention has a modulus of elasticity equivalent to, and a higher strength than, the conventional ultra high modulus carbon fiber on the market, and can be used efficiently for various industries such as space, motor car, aircraft, architecture and other widespread technical fields. In addition, when the high strength, ultra high modulus carbon fiber of the present invention is used for composite materials, not only the performance of the composite materials as final products will be improved but also the carbon fiber will be easily handled e.g., at the stage of producing the composite materials, because of the high strength and high elongation which results in improving largely the effect of the production.

EXAMPLES

The high strength, ultra high modulus carbon fiber of the present invention is now described in connection with an example and comparative examples thereof.

The following parameters and the method for measuring were adopted for the properties of carbon fiber in the examples.

Interlayer spacing ($d_{002}$), stack height ($Lc_{002}$) and layer size ($La_{110}$) are parameters which represent the fine structure of carbon fiber obtained by a wide angle X-ray diffraction pattern.

The stack height ($Lc_{002}$) represents the apparent stack height of (002) planes in a crystal of carbon fiber, and the interlayer spacing ($d_{002}$) represents the interlayer spacing of the (002) plane. In general, the larger the stack height ($Lc_{002}$) and the layer size ($La_{110}$), and the smaller the interlayer spacing ($d_{002}$), the better the crystallinity that can be obtained.

The stack height ($Lc_{002}$), the layer size ($La_{110}$) and the interlayer spacing ($d_{002}$) are obtained by grinding the fibers, in a mortar, to a powder, conducting a measurement and analysis in accordance with Gakushinho "Measuring . Method for Lattice Constant and Crystalline Size of Artificial Graphite", and using the following formula.

$$Lc_{002} = K\,\lambda/\beta\cos\theta$$

$$La_{110} = K\,\lambda/\beta'\cos\theta'$$

$$d_{002} = \lambda/2\sin\theta$$

where $K = 1.0$ $\lambda = 1.5418$ Å

$\theta$ is calculated from (002) diffraction angle $2\theta$, $\beta$ is the FWHM of (002) diffraction pattern calculated with correction, $\theta'$ is calculated from (110) diffraction angle 2θ, and $\beta'$ is the FWHM of (110) diffraction pattern calculated with correction.

In addition, the presence of (112) cross lattice line and the resolution of the diffraction band into two distinct lines (100) and (101) were determined using spectra of sufficiently good S/N ratio, by measuring the range to be observed applying a step scan method for several hours or more.

EXAMPLE 1

A carbonaceous pitch containing about 50% of an optically anisotropic phase (AP) was used as a precursor pitch, which was centrifuged in a cylindrical type continuous centrifugal separator with an effective volume of 200 ml in a rotor at a controlled rotor temperature of 360° C. under a centrifugal force of 10,000 G, to drain a pitch having an enriched optically anisotropic phase from an AP outlet. The resultant optically anisotropic pitch contained more than 99% optically anisotropic phase and had a softening point of 276° C.

Figure 2:
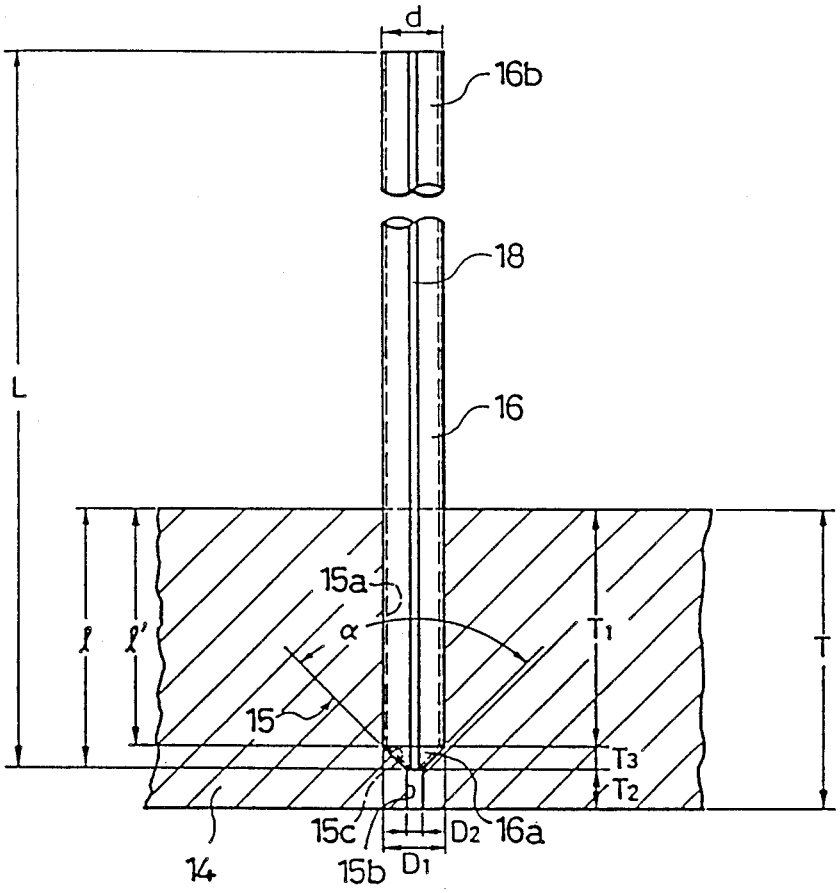
FIG. 2 is a sectional view of an embodiment of a spinneret applied to the spinning machine of FIG. 1 such as used in performing the present invention.
Figure 3:
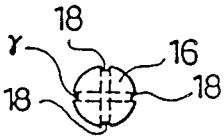
FIG. 3 is a top view of an embodiment of an inserted material for the spinneret of FIG. 2.

Then, the resultant optically anisotropic pitch was spun through a nozzle having a diameter of 0.3 mm, in a melt spinning machine, at 340° C. The structure of a spinning machine and a spinneret adopted in this example is shown in FIGS. 1 to 3.

Spinning machine 10 is equipped with a heating cylinder 12 in which melt pitch 11 (in particular, optically anisotropic pitch) is introduced from a pipe (not illustrated here), a plunger 13 which pressurizes the pitch in said heating cylinder 12, and a spinneret 14 fixed to the bottom of said heating cylinder 12. The spinneret 14 formed with a spinning nozzle 15 is fixed on the bottom of the heating cylinder 12 with bolts 17 and spinneret pressers 18. A spun pitch fiber is wound up by a winding bobbin 20 after passing through a spinning cylinder 19.

The spinning nozzle 15 (see FIG. 2) installed in the spinneret 14 used in this example is provided with a large diameter part **15*a* and a small diameter part 15*b*. A nozzle transmitting part 15*c* in the shape of truncated cone is formed between the large diameter part 15*a* and the small diameter part 15*b*. The spinneret 14 is made of stainless steel (SUS 304). The thickness (T) of the spinning nozzle part 15 is 5 mm and the lengths ($T_1$) and ($T_2$) of the large diameter part 15*a* and the small diameter part 15*b* are 4 mm and 0.65 mm, respectively. Furthermore, the diameter ($D_1$) and ($D_2$) of the large diameter part 15*a* and the small diameter part 15*b*** are 1 mm and 0.3 mm, respectively.

Inserted in the large diameter part **15*a* of the nozzle 15 is a slender rod 16, made of copper in this example, and having a larger thermal conductivity than the aforementioned spinneret 14. The rod 16 is introduced so that one end 16*a* is close to the inlet of the small diameter part 15*b*, and the other end 16*b* extends to the outside from the inlet of the large diameter part 15*a*. The overall length (L) is 20 mm and the diameter (d) indicated in FIG. 2 are so selected that the spacing between the large diameter part 15*a* and the rod 16 is 1/100 to 5/100 mm, with the aim that the rod may be smoothly introduced into large diameter part 15*a***, and may be securely maintained.

On the surface of the aforementioned rod 16, four grooves 18 were formed each in the shape of circular arc with 0.15 mm radius (r) and each extended along with the axis of the rod of said inserted slender pole so that melt pitch is introduced into the small diameter part **15*b***.

When melt pitch is spun using the spinning machine described above, and when the melt pitch passes through the spinning nozzle, the temperature decrease can be kept to within 3° C. The resultant pitch fiber was infusibilized in oxygen rich air containing 40% oxygen with a starting temperature of 180° C., a final temperature of 304° C., and a rate of increase of temperature of 6.2° C./min.

Upon completion of the infusibilization, the fiber was subjected to carbonization in an argon atmosphere. The fiber was heated at a rate of increase of temperature of 100° C./min to a final temperature of 2,700° C., to obtain fiber having a diameter of about 10 μm.

The X-ray diffraction pattern of the carbon fiber showed the presence of (112) cross lattice line and the resolution of (110) and (101) diffraction lines to be indices of three dimensional order. The carbon fiber had a stack height ($Lc_{002}$) of 220 Å, a layer size ($La_{110}$) of 240 Å and an interlayer-spacing ($d_{002}$) of 3.391 Å. In addition the carbon fiber had a Young's modulus of 774 GPa and a tensile strength of 3.60 GPa.

In addition, the carbon fibers had a preferred orientation angle ($\phi$) of 5.2°, the R value of Raman spectroscopy was 0.13 and the position of higher Kayser peak was 1,582 $cm^{-1}$.

The preferred orientation angle ($\phi$) shows the degree of preferred orientation of the crystallites in relation to the direction of fiber axis, and the smaller the angle, the better the orientation. Preferably, the preferred orientation angle ($\phi$) is 3° to 12°. When the preferred orientation angle is larger than 12°, the modulus of elasticity becomes poor. To reduce the orientation angle below 3° is not so economical since it requires a higher heating temperature.

The preferred orientation angle ($\phi$) is measured by using a fiber sample holder. Namely, while keeping the counter at that maximum diffraction intensity angle, the fiber sample holder is rotated through 360° to determine the intensity distribution of the (002) diffraction and the FWHM, i.e., the full width of the half maximum of the diffraction pattern is defined as the preferred orientation angle ($\phi$).

Furthermore, Raman scattering was measured by irradiating argon laser light to the carbon fiber bundle in the rectangular direction against the fiber axis. The Raman spectrum of carbon fiber was composed of two bands in the vicinity of 1,580 $cm^{-1}$ and in the vicinity of 1,360 $cm^{31\,1}$ in general. The band in the vicinity of 1,580 $cm^{-1}$ is caused by a graphite crystal, and the band in the vicinity of 1,360 $cm^{-1}$ is considered to be Raman activity by decrease or extinction of symmetry of the hexagonal lattice of the graphite crystal due to defects. Accordingly, the intensity ratio $I_{1,360}/I_{1,580}$ of two bands is called the R value and is used as an index of crystallinity. It can be considered in general that the smaller the R value the better the crystallinity of the fiber surface layer. In addition, the peak position of the higher Kayser band (in the vicinity of 1,580 $cm^{-1}$) becomes an index of crystallinity, and it gets near the value 1,575 $cm^{-1}$ of the graphite crystal as the crystallinity is improved.

The R value obtained by Raman spectroscopy is preferably 0.05 to 0.30, and the peak position of the higher Kayser band is preferably 1,585 $cm^{-1}$ or less. When the R value is larger than 0.30, the modulus of elasticity becomes poor, and when the value is smaller than 0.05, it is difficult to obtain a sufficient strength. When the peak position of the higher Kayser band is larger than 1,585 $cm^{-1}$, the modulus of elasticity becomes poor.

Comparative Example 1

The same pitch as in Example 1 was spun by using the same spinneret as in Example 1, but without the inserted rod 16, at a temperature of 330° C., and the pitch fiber obtained was infusibilized and carbonized under the same conditions as in Example 1. A carbon fiber about 10 μm in diameter was obtained.

The X-ray diffraction pattern of this carbon fiber showed the absence of (112) cross lattice line and the absence of resolution of the diffraction band into two distinct lines (100) and (101). Its stack height ($Lc_{002}$) was 210 Å, its layer size ) was 230 Å and its interlayer spacing ($d_{002}$) of the layer planes was 3.390 Å. The carbon fiber had a modulus of elasticity of 685 GPa and a tensile strength of 2.37 GPa. These values were inferior to the properties of the carbon fiber made according to Example 1 of the present invention.

Comparative Example 2

The same pitch as in Example 1 was spun by the same method as in Example 1, and the pitch fibers obtained were infusibilized and carbonized under the same conditions as in Example 1 except that the carbonization temperature is 2,300° C. A carbon fiber with about 10 μm in diameter was obtained.

The X-ray diffraction pattern of the carbon fiber showed the absence of (112) cross lattice line and the absence of resolution of the diffraction band into two distinct lines (100) and (101). Its stack height ($Lc_{002}$) was 120 Å, its layer size was 110 Å and its interlayer spacing of the layer planes was 3.427 Å. The carbon fiber had a modulus of elasticity of 512 GPa and a tensile strength of 3.32 GPa. These values were inferior to the properties of the carbon fiber made according to Example 1.

Comparative Example 3

A carbonaceous pitch containing about 90% of an optically anisotropic phase (AP) was used as a precursor pitch. It was centrifuged in a cylindrical type continuous centrifugal separator with an effective volume of 200 ml in a rotor at a controlled rotor temperature of 360° C. under a centrifugal force of 10,000 G, to drain a pitch having an enriched optically anisotropic phase from an AP outlet. The resultant optically anisotropic pitch contained a more than 99% optically anisotropic phase and had a softening point of 287° C.

The pitch thus obtained was spun using the same spinneret as in Example 1, but without the rod 16, at a temperature of 340° C., and the pitch fiber was infusibilized and carbonized under the same conditions as in Example 1 except that the carbonization temperature was 3,000° C. A carbon fiber about 10 μm in diameter was obtained.

The X-ray diffraction pattern of the carbon fiber showed the presence of (112) cross lattice line and the presence of resolution of the diffraction band into two distinct lines (100) and (101). However, its stack height ($Lc_{002}$) was 600 Å, its layer size ($La_{110}$) was 900 Å and its interlayer spacing ($d_{002}$) of the layer planes was 3.372 Å. The carbon fiber had a modulus of elasticity of 746 GPa and a tensile strength of 2.25 GPa. These values were inferior to the properties of the carbon fiber made according to Example 1.

We claim:

1. A high strength, ultra high modulus carbon fiber characterized by the presence of the (112) cross lattice line and the resolution of the defraction band into two distinct lines (100) and (101), which indicate the three dimensional order of the crystallite of the fiber; an interlayer spacing ($d_{002}$) of 3.371 to 3.40 Å; a stack height ($Lc_{002}$) of 170 to 350 Å; and a layer size ($La_{110}$of 200 to 450 Å, wherein said carbon fiber as a tensile strength of 3.0 GPa or more and a modulus of elasticity of 600 GPa or more.

2. A carbon fiber according to claim 1, having a orientation angle ($\phi$) of 3° to 12°.

3. A carbon fiber according to any of claims 1 or 3, wherein the R value obtained by Raman spectroscopy is 0.05 to 0.30 and the peak position of the higher kayser band is 1585 $cm^{-1}$ or less.

* * * * *